US010497351B2

(12) United States Patent
Zhu et al.

(10) Patent No.: US 10,497,351 B2
(45) Date of Patent: Dec. 3, 2019

(54) PACKAGING STRUCTURE OF ACOUSTIC ABSORBENT AND SPEAKER BOX USING SAME

(71) Applicant: AAC Technologies Pte. Ltd., Singapore (SG)

(72) Inventors: Jie Zhu, Shenzhen (CN); Bin Zhao, Shenzhen (CN); Sheng Ye, Shenzhen (CN); Minmin Chen, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 255 days.

(21) Appl. No.: 15/646,811

(22) Filed: Jul. 11, 2017

(65) Prior Publication Data

US 2018/0254032 A1 Sep. 6, 2018

(30) Foreign Application Priority Data

Mar. 1, 2017 (CN) ..... 2017 2 0196566 U

(51) Int. Cl.
*G10K 11/162* (2006.01)
*H04R 1/02* (2006.01)
*H04R 1/28* (2006.01)

(52) U.S. Cl.
CPC ..... *G10K 11/162* (2013.01); *H04R 1/02* (2013.01); *H04R 1/288* (2013.01)

(58) Field of Classification Search
CPC ..... H04R 1/02; H04R 1/288; G10K 11/162
USPC ..... 181/151
See application file for complete search history.

(56) References Cited

U.S. PATENT DOCUMENTS 4,044,855 A * 8/1977 Kobayashi ..... H04R 1/22 181/151
4,657,108 A * 4/1987 Ward ..... H04R 1/2803 181/149
7,743,880 B2 * 6/2010 Matsumura ..... B61D 17/185 181/151
8,885,863 B2 * 11/2014 Takashima ..... C01B 32/158 381/354
2004/0251077 A1 * 12/2004 Wright ..... H04R 1/2803 181/151
2008/0135327 A1 * 6/2008 Matsumura ..... B61D 17/185 181/151
2010/0206658 A1 * 8/2010 Slotte ..... H04R 1/225 181/151

* cited by examiner

*Primary Examiner* — Forrest M Phillips
(74) *Attorney, Agent, or Firm* — IPro, PLLC; Na Xu

(57) ABSTRACT

The present disclosure provides a packaging structure of acoustic absorbent. The packaging structure of acoustic absorbent, includes a housing with an accommodating cavity, the housing including a bottom wall and a warding wall extending from the bottom wall; acoustic absorbent filling the accommodating cavity; a welding bracket; and an air-permeable isolator located between the warding wall and the welding bracket for packaging the acoustic absorbent inside the accommodating cavity. The air-permeable isolator and the welding bracket are fixed through ultrasonic welding. In addition, the present disclosure also provide a speaker box using the packaging structure of acoustic absorbent disclosed.

7 Claims, 3 Drawing Sheets

PACKAGING STRUCTURE OF ACOUSTIC ABSORBENT AND SPEAKER BOX USING SAME

CROSS-REFERENCE TO RELATED APPLICATIONS

This application claims the priority benefit of Chinese Patent Application Ser. No. 201610398572.9 filed on Jun. 7, 2016, the entire content of which is incorporated herein by reference.

FIELD OF THE PRESENT DISCLOSURE

The present disclosure relates to the field of electroacoustic transducers, more particularly to a speaker box using a packaging structure of acoustic absorbent.

DESCRIPTION OF RELATED ART

A packaging structure of acoustic absorbent of related technologies includes a housing with an accommodating cavity, acoustic absorbent filling the accommodating cavity and a packaging net packaging the acoustic absorbent inside the accommodating cavity. The packaging net is connected to the housing by way of hot melting, concretely, a heat pressing tooling first melts the material of the housing and then wraps up the packaging net. However, the way of hot melting is subject to the risks of the binding strength of the packaging net being not strong and the hot melting consistency not being good, and the reduction of the height of the housing will result in the reduction of the filling volume for the acoustic absorbent. In addition, the heat pressing tooling may press too deep when hot melting the packaging net, which may cause net face wrinkling and inward denting phenomenon during the packaging net warping up process, that is because the hot melting side material of the housing may overflow inward and cause the packaging net to dent inward, this phenomenon will affect the appearance of the products and reduce the filling volume for the acoustic absorbent and thus cause the F0 of the products to increase. But if the downward pressing depth is not enough, the hot melting side width will be therefore too narrow and the binding strength will not be strong, increasing the risk of acoustic absorbent leakage.

Therefore it is necessary to provide an improved solution for overcoming the above-mentioned disadvantages.

BRIEF DESCRIPTION OF THE DRAWING

Many aspects of the exemplary embodiment can be better understood with reference to the following drawing. The components in the drawing are not necessarily drawn to scale, the emphasis instead being placed upon clearly illustrating the principles of the present disclosure.

DETAILED DESCRIPTION OF THE EXEMPLARY EMBODIMENT

The present disclosure will hereinafter be described in detail with reference to an exemplary embodiment. To make the technical problems to be solved, technical solutions and beneficial effects of the present disclosure more apparent, the present disclosure is described in further detail together with the figure and the embodiment. It should be understood the specific embodiment described hereby is only to explain the disclosure, not intended to limit the disclosure.

Figure 1:
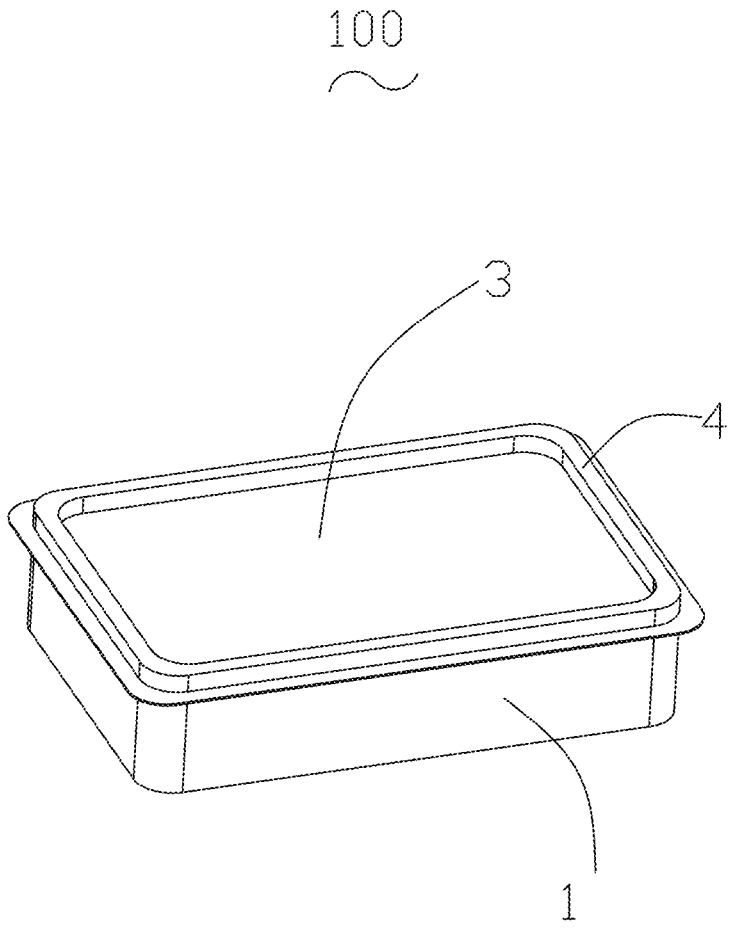
FIG. 1 is an isometric view of a packaging structure of acoustic absorbent in accordance with an exemplary embodiment of the present disclosure.
Figure 2:
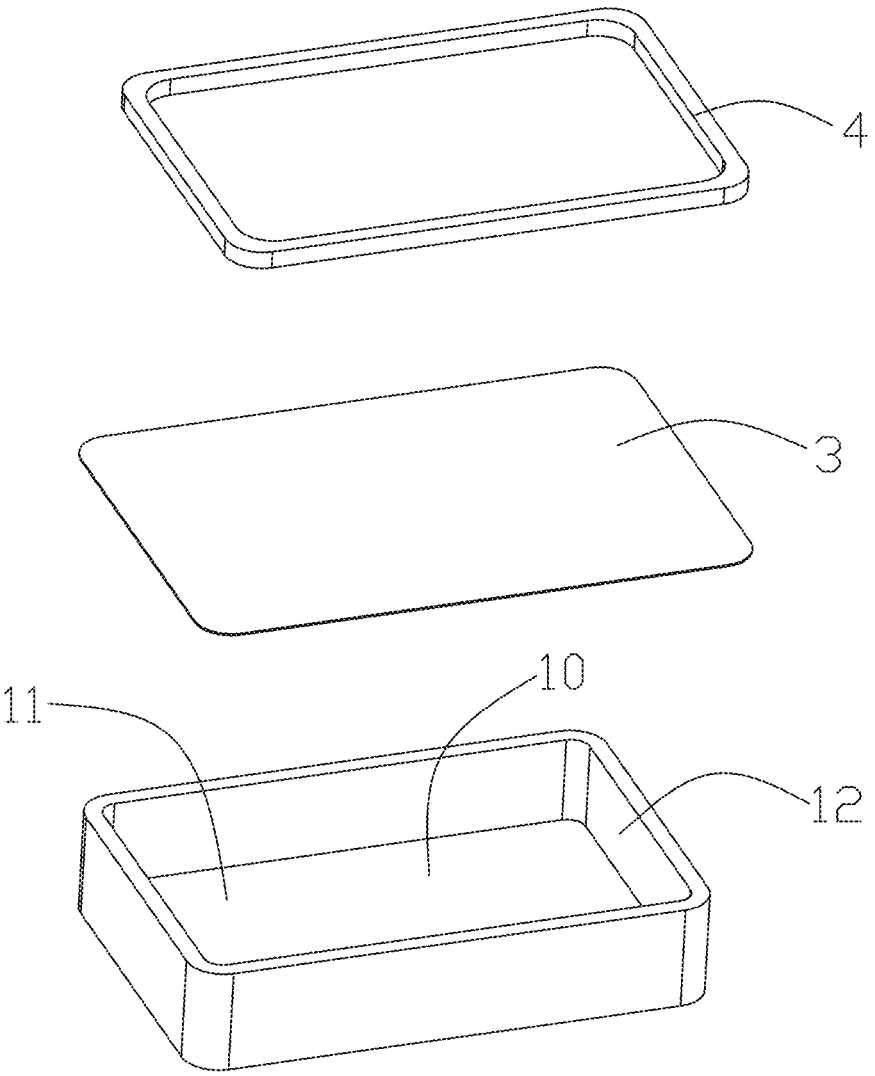
FIG. 2 is an isometric and exploded view of the packaging structure of acoustic absorbent in FIG. 1.
Figure 3:
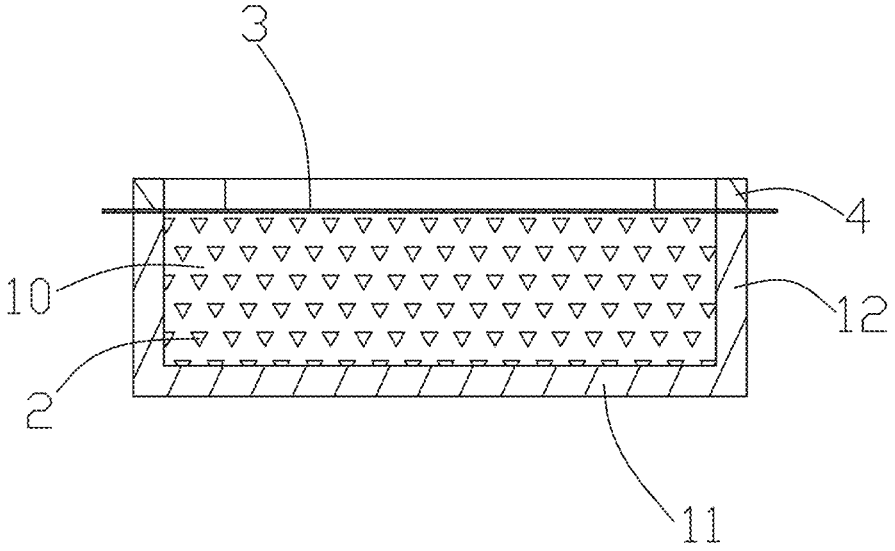
FIG. 3 is a cross-sectional view of the packaging structure of acoustic absorbent.

As shown in FIGS. 1-3, the present disclosure provides a packaging structure of acoustic absorbent 100, which includes a housing 1 with an accommodating cavity 10, acoustic absorbent 2 filling the accommodating cavity 10 and an air-permeable isolator 3 packaging the acoustic absorbent 2 inside the accommodating cavity 10. The housing 1 includes a bottom wall 11 and a warding wall 12 extending from the bottom wall 11. The packaging structure of acoustic absorbent 100 further includes a welding bracket 4, and the air-permeable isolator 3 is provided between the warding wall 12 and the welding bracket 4. The warding wall 12, the air-permeable isolator 3 and the welding bracket 4 are fixed through ultrasonic welding.

Optionally, the form of the welding bracket 4 matches that of the warding wall 12. The matching of form means that the welding bracket 4 and the warding wall 12 have the same outline and form, only the size of the height direction is different, the height direction refers to the direction from the bottom wall 11 to the air-permeable isolator 3.

The welding bracket 4 and the warding wall 12 are made of the same material, both of, for example, PP plastics. Of course, the welding bracket 4 and the warding wall 12 can be made of different materials, but the materials should meet the requirements of ultrasonic welding.

In this embodiment, the housing 1 should be, preferably, an all-in-one formed structure, and for the acoustic absorbent 2, zeolite powder can be a choice, and the air-permeable isolator 3 can be net cloth or metal gauze.

The present disclosure also provides a speaker box, which includes a packaging structure of acoustic absorbent 100. The packaging structure of acoustic absorbent 100 can be a separate device provided inside the case of the speaker box, can also serve as a housing 1 of the packaging structure of acoustic absorbent 100 by using the structure of the case of the speaker box, e.g., the plastic case of the speaker box can be shaped into the structure of the housing 1. In addition, it is also possible that the metal piece fixed on the plastic case of the speaker box serves as the bottom wall 11 of the housing 11, while the warding wall 12 is a part structure the plastic case of the speaker box. The specific embodiment can be selected according to different application environments.

It is to be understood, however, that even though numerous characteristics and advantages of the present exemplary embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms where the appended claims are expressed.

What is claimed is:

1. A packaging structure of acoustic absorbent, including:

a housing with an accommodating cavity, the housing including a bottom wall and a warding wall extending from the bottom wall;

acoustic absorbent filling the accommodating cavity;

a welding bracket;

an air-permeable isolator sandwiched between the warding wall and the welding bracket for packaging the acoustic absorbent inside the accommodating cavity; wherein the warding wall and the welding bracket are fixed through ultrasonic welding so as to fix the air-permeable isolator between the warding wall and the welding bracket.

2. The packaging structure of acoustic absorbent as described in claim 1, wherein a form of the welding bracket matches that of the warding wall.

3. The packaging structure of acoustic absorbent as described in claim 1, wherein the welding bracket and the warding wall are made of the same material.

4. The packaging structure of acoustic absorbent as described in claim 1, wherein the housing is integrally formed.

5. The packaging structure of acoustic absorbent as described in claim 1, wherein the acoustic absorbent is zeolite powder.

6. The packaging structure of acoustic absorbent as described in claim 1, wherein the air-permeable isolator is net cloth or metal gauze.

7. A speaker box including a packaging structure of acoustic absorbent as described in claim 1.

* * * * *